US011132929B2

(12) United States Patent
Liao et al.

(10) Patent No.: US 11,132,929 B2
(45) Date of Patent: Sep. 28, 2021

(54) METHOD AND APPARATUS FOR CONTROLLING ON-SCREEN DISPLAY

(71) Applicant: BEIJING XIAOMI MOBILE SOFTWARE CO., LTD., Beijing (CN)

(72) Inventors: Yijing Liao, Beijing (CN); Ming Liu, Beijing (CN); Chunming Xiao, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 16/907,362

(22) Filed: Jun. 22, 2020

(65) Prior Publication Data

US 2021/0217346 A1 Jul. 15, 2021

(30) Foreign Application Priority Data

Jan. 10, 2020 (CN) ..... 202010027234.0

(51) Int. Cl.

*G09G 5/10* (2006.01)
*G09G 3/20* (2006.01)
*G09G 5/02* (2006.01)

(52) U.S. Cl.

CPC ..... *G09G 3/2003* (2013.01); *G09G 5/026* (2013.01); *G09G 5/10* (2013.01); *G09G 2320/0626* (2013.01); *G09G 2320/0666* (2013.01); *G09G 2360/144* (2013.01)

(58) Field of Classification Search

CPC ..... G09G 3/2003; G09G 5/026; G09G 5/10; G09G 2320/0626

USPC ..... 345/690

See application file for complete search history.

(56) References Cited

U.S. PATENT DOCUMENTS

2010/0020052 A1* 1/2010 Kim ..... H04N 5/58 345/207
2016/0140906 A1 5/2016 Choi
2017/0025091 A1* 1/2017 Haddick ..... G02B 27/0179
2018/0211607 A1 7/2018 Kabacinski et al.

FOREIGN PATENT DOCUMENTS

EP 2037677 A1 3/2009
EP 3425619 A1 1/2019

OTHER PUBLICATIONS

Partial European Search Report in Application No. 201845005, dated Aug. 3, 2020.

* cited by examiner

*Primary Examiner* — Jonathan M Blancha
(74) *Attorney, Agent, or Firm* — Syncoda LLC; Feng Ma

(57) ABSTRACT

A method for controlling OSD can include: acquiring ambient light information; setting, according to the ambient light information, OSD parameters suitable for an OSD effect in current light environment; and, performing OSD according to the OSD parameters. OSD parameters can be adjusted in real time according to the ambient light, such that the OSD effect is more suitable for a user's visual feel when viewing a screen in the current light environment.

18 Claims, 4 Drawing Sheets

METHOD AND APPARATUS FOR CONTROLLING ON-SCREEN DISPLAY

CROSS-REFERENCE TO RELATED APPLICATION

This application claims priority to Chinese Patent Application No. 202010027234.0 filed on Jan. 10, 2020, the disclosure of which is hereby incorporated by reference in its entirety.

BACKGROUND

For many applications, due to their own styles, user preferences, etc., display interfaces are often designed to be black. Based on this design style, a dark mode emerges. The dark mode is a mode in which the contrast between the text foreground and the dark background and the colors of text and system icons are optimized based on lots of "human factor studies" to ensure that it is consistent, comfortable and easy to read when viewing with human eyes. Unlike the light background, in the dark mode, the dark color is used as the main tone of the display interface.

SUMMARY

In accordance with a first aspect of the embodiments of the present disclosure, a method for controlling On-Screen Display (OSD) is provided, including:

acquiring ambient light information;

setting, according to the ambient light information, OSD parameters suitable for an OSD effect in current light environment; and performing OSD according to the OSD parameters.

In some embodiments, in the method, the setting, according to the ambient light information, OSD parameters suitable for an OSD effect in current light environment includes:

when it is determined that the OSD mode is a dark mode, setting color values of inverse colors of a first type of colors according to the ambient light information, the first type of colors including colors having a brightness value in a color mode that is greater than or equal to a first set brightness value, the color values of the inverse colors of the first type of colors being negatively related to the ambient light information.

In some embodiments, in the method, the setting, according to the ambient light information, OSD parameters suitable for an OSD effect in current light environment includes:

when it is determined that the OSD mode is a dark mode, setting color values of inverse colors of a second type of colors according to the ambient light information, the second type of colors including colors having a brightness value in a color mode that is smaller than or equal to a second set brightness value, the color values of the inverse colors of the second type of colors being positively related to the ambient light information.

In some embodiments, in the method, the setting, according to the ambient light information, OSD parameters suitable for an OSD effect in current light environment includes:

setting OSD parameters suitable for the OSD effect in the current light environment in a preset way;

wherein the preset way at least includes any one of the following ways:

upon acquiring the ambient light information, setting OSD parameters after a first set time delay.

In some embodiments, the method further includes:

adjusting screen brightness according to the ambient light information, the adjusted screen brightness being positively related to the ambient light information when the OSD mode is a dark mode.

In some embodiments, the method further includes:

when the OSD mode is a dark mode and if the acquired ambient light information is smaller than a set threshold, adding an obscuration layer for OSD.

In accordance with a second aspect of the embodiments of the present disclosure, an apparatus for controlling On-Screen Display (OSD) is provided, including:

a processor; and a memory device configured to store instructions executable for the processor that, when executed by the processor, causes the processor to:

acquire ambient light information;

set, according to the ambient light information, OSD parameters suitable for an OSD effect in current light environment; and perform OSD according to the OSD parameters.

In some embodiments, in the apparatus, the instructions further causes the processor to:

set color values of inverse colors of a first type of colors according to the ambient light information when it is determined that the OSD mode is a dark mode, the first type of colors comprising colors having a brightness value in a color mode that is greater than or equal to a first set brightness value, the color values of the inverse colors of the first type of colors being negatively related to the ambient light information.

In some embodiments, in the apparatus, the instructions further cause the processor to:

set color values of inverse colors of a second type of colors according to the ambient light information when it is determined that the OSD mode is a dark mode, the second type of colors comprising colors having a brightness value in a color mode that is smaller than or equal to a second set brightness value, the color values of the inverse colors of the second type of colors being positively related to the ambient light information.

In some embodiments, in the apparatus, the instructions further cause the processor to:

set OSD parameters suitable for the OSD effect in the current light environment in a preset way;

wherein the preset way at least includes the following way:

upon acquiring the ambient light information, setting OSD parameters after a first set time delay.

In some embodiments, in the apparatus, the instructions further cause the processor to:

adjust screen brightness according to the ambient light information, the adjusted screen brightness being positively related to the ambient light information when the OSD mode is a dark mode.

In some embodiments, in the apparatus, the instructions further cause the processor to:

add an obscuration layer for OSD when the OSD mode is a dark mode and if the acquired ambient light information is smaller than a set threshold.

In accordance with a third aspect of the embodiments of the present disclosure, a non-temporary computer-readable storage medium is provided, instructions in the storage medium, when executed by a processor of a terminal device, enabling the terminal device to execute a method for controlling On-Screen Display (OSD), the method including operations of:

acquiring ambient light information;

setting, according to the ambient light information, OSD parameters suitable for an OSD effect in current light environment; and performing OSD according to the OSD parameters.

It should be understood that the foregoing general description and the following detailed description are merely exemplary and explanatory and are not intended to limit the present disclosure.

BRIEF DESCRIPTION OF THE DRAWINGS

The accompanying drawings to be described herein are incorporated into this disclosure and constitute a part of this disclosure. These accompanying drawings show some embodiments of the present disclosure, and are used with this specification to explain principle of the present disclosure.

DETAILED DESCRIPTION

Figure 1:
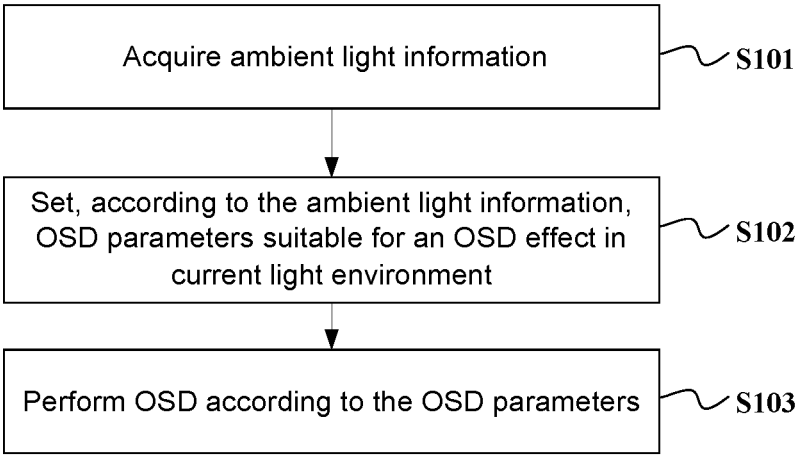
FIG. 1 is a flowchart of a method for controlling OSD according to some embodiments.

Exemplary embodiments will be described in detail herein, and examples in the exemplary embodiments are shown in the accompanying drawings. When the accompanying drawings are involved in the following description, unless otherwise indicated, identical reference numerals in different accompanying drawings indicate identical or similar elements. The implementations described in the following exemplary embodiments do not represent all implementations consistent with the present disclosure. Instead, these implementations are merely examples of apparatuses and methods consistent with some aspects of the present disclosure as described in the appended claims.

There are typically two resource configurations (i.e., a light resource configuration and a dark resource configuration) on a terminal side. When the system is set to be in a light mode, the light resource configuration is used, and the display interface is relatively bright and fresh in color. Since the light mode is brighter in color, it is more suitable for use during daytime. When the light mode is used at night, the bright display may adversely affect the user's vision.

When the system is set to be in a dark mode, the dark resource configuration is used, and the display interface is relatively dark in color. Since the dark mode is darker in color, it is more suitable for use at night. When the dark mode is used during daytime, the contrast between the display content and the background in the interface is relatively low, and the user may not be able to clearly see the display content.

Typically, the terminal device only provides options for the light mode and the dark mode, that is, the user can only select the light or dark mode function. Since different applications in the terminal equipment are different in adaptability, it may not be suitable for all applications when the user selects the dark mode function. Based on this, in the related art, all applications are forcibly displayed in the dark mode, to solve the problem of poor adaptability of applications. However, if the content can be clearly displayed during daytime when display is performed in the current dark mode, the screen will be too dazzling, influencing the user's use. On the contrary, if the user can clearly recognize the display content when the dark mode is used at night, unclear screen display will occur when the dark mode is used during daytime, so that the user experience is also influenced.

Various embodiments of the present disclosure can provide a method and apparatus for controlling On-Screen Display (OSD), which can adaptively adjust the OSD effect in different light environments and As such. improve the user experience.

FIG. 1 is a flowchart of a method for controlling OSD according to some embodiments. As shown in FIG. 1, the method includes the following steps.

Step S101: Ambient light information is acquired.

Step S102: OSD parameters suitable for an OSD effect in the current light environment are set according to the ambient light information.

Step S103: OSD is performed according to the OSD parameters.

Herein, the ambient light information may include various information indicating light intensity. For example, the ambient light information includes light intensity information, illumination intensity information or the like. The light intensity refers to the luminous intensity, in unit of candela (which can be abbreviated as cd). The light intensity can be used for indicating the convergence capability of the luminous body in spatial emission. That is, it can indicate how bright the light source is. The light intensity information refers to the luminous flux of visible light received per unit area, in unit of Lux or lx. The light intensity information can indicate the intensity of illumination and the amount of illumination on the surface area of the object. In these embodiments, the ambient light information may be acquired in various ways.

For example, the terminal equipment may receive the ambient light information from other devices. It is also possible that the ambient light information is acquired in real time by an ambient light sensor (e.g., a camera, etc.) of the terminal equipment. The ambient light information may be acquired in real time, or acquired periodically according to the set period. The shorter the set period is, the higher the frequency of acquiring the ambient light information is. Thus, the OSD effect can be adjusted more timely according to the ambient light information, and the visual comfort of the user when viewing the screen is improved.

In the step S102, when setting OSD parameters, the display parameters can be adjusted according to the best visual contrast in the current light environment. In other words, the OSD parameters are dynamically adjusted according to the intensity of the ambient light, so that the OSD effect can be suitable for the user to view under strong light or weak light. Herein, the OSD parameters at least include various parameters related to the OSD effect, or the like. For example, the OSD parameters may include the color value of a color, the color value of an inverse color of the color, or the like.

As such, in these embodiments, it is considered that the change in the ambient light will directly influence the OSD effect, i.e., influence the user's visual effect when using the electronic device. Therefore, the OSD parameters can be dynamically adjusted according to the ambient light information acquired in real time, so that the OSD effect is improved in real time. Accordingly, the user can comfortably view the screen of the terminal in various light environments, and the user experience is improved.

Various embodiments of the present disclosure further provide a method for controlling On-Screen Display (OSD).

In this method, the setting, according to the ambient light information, OSD parameters suitable for an OSD effect in the current light environment includes:

when it is determined that the OSD mode is a dark mode, setting color values of inverse colors of a first type of colors according to the ambient light information, the first type of colors including colors having a brightness value in a color mode that is greater than or equal to a first set brightness value, the color values of the inverse colors of the first type of colors being negatively related to the ambient light information.

Inverse color display is involved when the OSD is performed in the dark mode, and the color value of the inverse color of a color during the inverse color display can indicate the brightness of the inverse color. The brightness of the inverse color will influence the contrast of the user interface in the dark mode, i.e., the OSD effect. Therefore, in accordance with the technical solution provided in these embodiments, the color value of the inverse color of a color in a color mode can be adjusted in real time according to the change of the ambient light, to optimize the display effect in the dark mode.

Herein, the first type of colors includes various bright colors, and the minimum brightness value for the bright colors can be indicated by a first set brightness value. In other words, colors having a brightness value greater than or equal to the first set brightness value belong to the first type of colors herein. By taking a LAB (L, a, b) color mode as an example, the maximum value of L is 110, so the first set brightness value may be set as 55 or 60.

The set color values of the inverse colors of the first type of colors being negatively related to the ambient light information means that the set color values of the inverse colors of the first type of colors will decrease with the increase of the ambient light information. The set color values of the inverse colors of the first type of colors will increase with the decrease of the ambient light information.

As described above, in the dark mode, the brightness of the inverse color will influence the contrast of the user interface in the dark mode, i.e., the OSD effect. As the ambient light information increases, the ambient light becomes stronger. When the set color values of the inverse colors of the first type of colors decrease, it is equivalent that the dark colors in the displayed picture of the screen in the dark mode become darker. In this way, the difference in brightness between the brightest region and the darkest region in the picture displayed on the screen in the dark mode becomes greater, and the achieved visual effect is that the contrast of the displayed picture of the screen becomes higher. That is, in a strong light environment, when the terminal equipment performs OSD in the dark mode, the user can clearly view the contents of the displayed picture, thereby achieving more comfortable visual feel and improving the user experience in the dark mode.

Correspondingly, as the ambient light information decreases, the ambient light becomes weaker. When the set color values of the inverse colors of the first type of colors increase, it is equivalent that the dark colors in the displayed picture of the screen in the dark mode become brighter. In this way, the difference in brightness between the brightest region and the darkest region in the displayed picture of the screen in the dark mode becomes smaller, and the achieved visual effect is that the contrast of the displayed picture of the screen becomes lower. That is, in a weak light environment, when the terminal equipment performs OSD in the dark mode, the user can clearly view the contents of the displayed picture and will not be stimulated by the light from the screen, thereby achieving more comfortable visual feel. Moreover, the display effect with a lower contrast can save the power consumption of the terminal equipment, thereby saving power.

Thus, in these embodiments, the user can normally use the dark mode in any light environment (including daytime and night) without switching between the dark mode and the light mode, so that the user experience is improved. With the technical solution provided in these embodiments, the dark mode can be normally used without adapting to the applications in the terminal equipment in advance, so that better user experience is achieved.

Various embodiments of the present disclosure further provide a method for controlling On-Screen Display (OSD). In this method, the setting, according to the ambient light information, OSD parameters suitable for an OSD effect in the current light environment includes:

when it is determined that the OSD mode is a dark mode, setting color values of inverse colors of a second type of colors according to the ambient light information, the second type of colors including colors having a brightness value in a color mode that is less than or equal to a second set brightness value, the color values of the inverse colors of the second type of colors being positively related to the ambient light information.

Herein, the second type of colors includes various dark colors, and the maximum brightness value for the dark colors can be indicated by a second set brightness value. In other words, colors having a brightness value less than or equal to the second set brightness value belong to the second type of colors herein. As described above, the first set brightness value can be used for indicating the minimum brightness value for the bright colors. However, in these embodiments, the second set brightness value can be used for indicating the maximum brightness value for the dark colors. Therefore, the first set brightness value may be greater than or equal to the second set brightness value. By taking a LAB color mode as an example, the maximum value of L is 110. When the first set brightness value is equal to the second set brightness value, both the first set brightness value and the second set brightness value may be set as 55. When the first set brightness value is greater than the second set brightness value, the first set brightness value may be set as 60 and the second set brightness value may be set as 45.

The set color values of the inverse colors of the second type of colors being positively related to the ambient light information means that the set color values of the inverse colors of the first type of colors will increase with the increase of the ambient light information. The set color values of the inverse colors of the first type of colors will decrease with the decrease of the ambient light information.

In these embodiments, as the ambient light information increases, the ambient light becomes stronger. At this time, the set color values of the inverse colors of the second type of colors also increase, and it is equivalent that the bright colors in the displayed picture of the screen in the dark mode become brighter. In this way, the difference in brightness between the brightest region and the darkest region in the displayed picture of the screen in the dark mode becomes greater, and the achieved visual effect is that the contrast of the displayed picture of the screen becomes higher. That is, in a strong light environment, when the terminal equipment performs OSD in the dark mode, the user can clearly view the contents of the displayed picture, thereby achieving more comfortable visual feel and improving the user experience in the dark mode.

Correspondingly, as the ambient light information decreases, the ambient light becomes weaker. At this time, the set color values of the inverse colors of the second type of colors also decrease, and it is equivalent that the bright colors in the displayed picture of the screen in the dark mode become darker. In this way, the difference in brightness between the brightest region and the darkest region in the displayed picture of the screen in the dark mode becomes smaller, and the achieved visual effect is that the contrast of the displayed picture of the screen becomes lower. That is, in a weak light environment, when the terminal equipment performs OSD in the dark mode, the user can clearly view the content of the displayed picture and will not be stimulated by the light from the screen, thereby achieving more comfortable visual feel. Moreover, the display effect with a lower contrast can save the power consumption of the terminal equipment, thereby saving power.

As such, in these embodiments, the user can normally use the dark mode in any light environment (including daytime and night) without switching between the dark mode and the light mode, so that the user experience is improved. With the technical solution provided in these embodiments, the dark mode can be normally used without adapting to the applications in the terminal equipment in advance, so that better user experience is achieved.

Various embodiments of the present disclosure further provide a method for controlling On-Screen Display (OSD), further including a step of:

adjusting screen brightness according to the ambient light information, the adjusted screen brightness being positively related to the ambient light information when the OSD mode is a dark mode.

In these embodiments, when display is performed in a dark mode, screen brightness can be adjusted according to the ambient light information, that is, screen brightness is dynamically adjusted according to the change in the ambient light. When the ambient light becomes stronger, the screen brightness can be increased, so that the user can easily and clearly view the contents on the screen when the dark mode is used for display under strong light. When the ambient light becomes weaker, the screen brightness can be deceased, so that the user can easily and clearly view the contents on the screen when the dark mode is used for display under weak light. Thus, in these embodiments, the user's experience when using the dark mode in various scenarios is improved.

Additionally, in these embodiments, in a color mode involved in the dark mode, color values of all colors may be configured in advance. That is, herein, a set of color values are newly configured for display in the dark mode, and the newly configured color values may be slightly different from the standard color values used in the related art. Correspondingly, the inverse color values of the newly configured color values may also be different from the inverse color values of the standard color values used in the related art. The inverse color values corresponding to the newly configured color values are initial values of the inverse color values adjusted herein. Since the newly configured color values are configured based on the principle of optimizing the contrast effect in the dark mode, when the inverse color values are adjusted as initial values in these embodiments, better contrast effect of display in the dark mode is achieved, and the purpose of optimizing display in the dark mode is realized.

Various embodiments of the present disclosure further provide a method for controlling On-Screen Display (OSD), further including a step of:

when the OSD mode is a dark mode and if the acquired ambient light information is less than a set threshold, adding an obscuration layer for OSD.

The set threshold may be used for indicating the maximum light intensity value in the weak light environment. In other words, when the acquired ambient light information is less than the set threshold, it can be considered that the electronic device is currently in a weak light environment, for example, at night, in a dark tunnel or the like. In these embodiments, the set threshold may be 30 lux.

In these embodiments, adding the obscuration layer can be regarded as a way suitable for display processing in the weak light environment. For example, in the related art, an obscuration layer will be added for display when display is performed in a night mode.

As such, in these embodiments, by adding an obscuration layer in a weak light environment, the contrast of display in the dark mode becomes lower in the weak light environment, so that it is more suitable for the user to view and the user's experience in the dark mode is improved.

Figure 2:
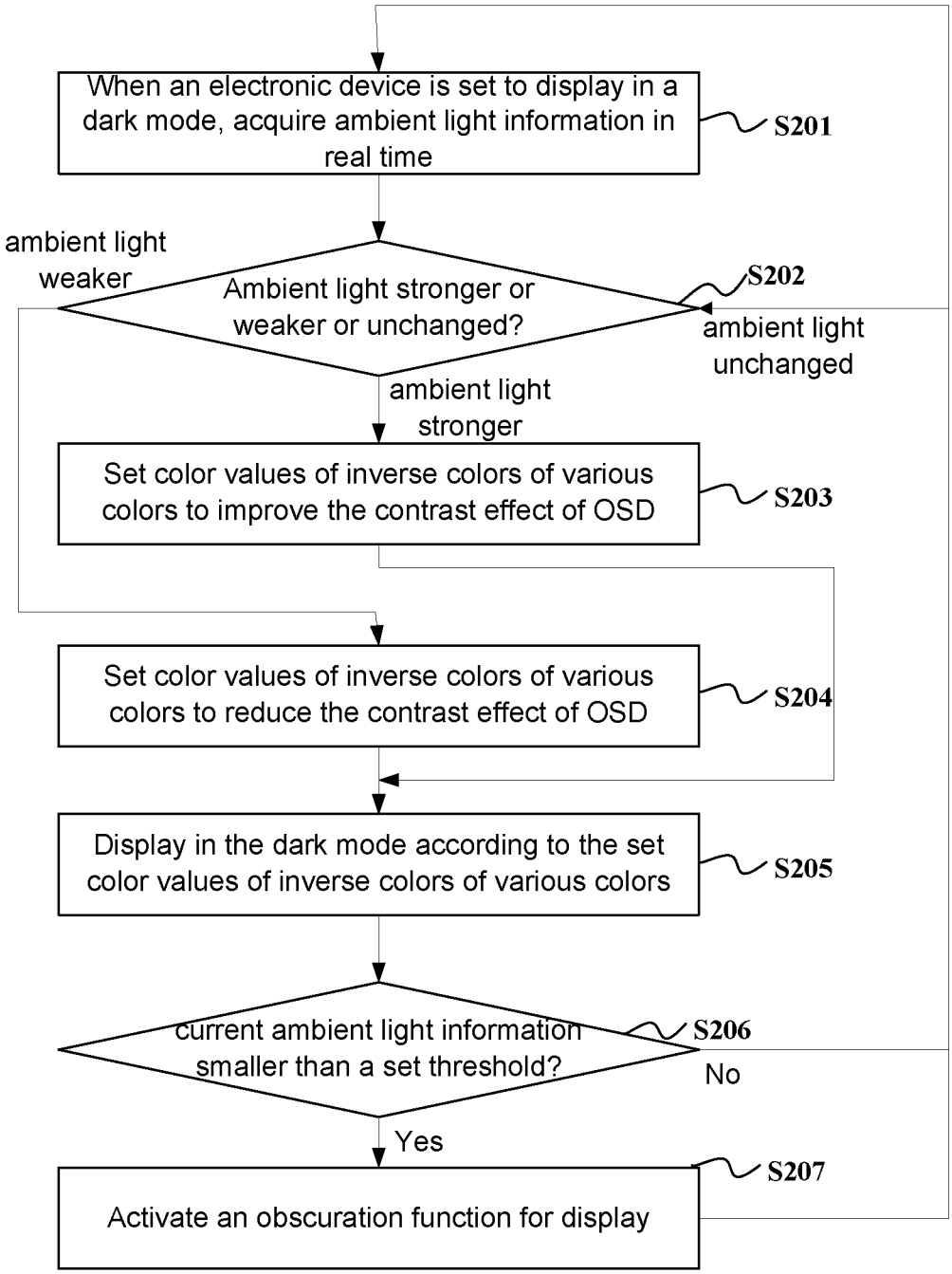
FIG. 2 is a flowchart of a method for controlling OSD according to some embodiments.

FIG. 2 is a flowchart of a method for controlling OSD according to some embodiments. As shown in FIG. 2, the method includes the following operation steps.

Step S201: When an electronic device is set to display in a dark mode, ambient light information is acquired in real time.

The ambient light information may be acquired by an ambient light sensor arranged in the electronic device.

The current ambient light information includes light intensity and/or illumination intensity.

Step S202: It is determined whether the ambient light becomes stronger or weaker or remains unchanged; the process proceeds to a step S203 if the ambient light becomes stronger; the process proceeds to a step S204 if the ambient light becomes weaker; and, the process returns to the step S201 if the ambient light remains unchanged.

If the value of the ambient light information acquired at the current moment is greater than the value of the ambient light information at the previous moment, it is determined that the ambient light becomes stronger. If the value of the ambient light information acquired at the current moment is smaller than the value of the ambient light information at the previous moment, it is determined that the ambient light becomes weaker. If the value of the ambient light information acquired at the current moment is equal to the value of the ambient light information at the previous moment, it is determined that the ambient light remains unchanged.

Other determination methods may also be used in the step S202 as long as the change trend of the ambient light information within a certain period of time can be determined.

Step S203: Color values of inverse colors of various colors are set to improve the contrast effect of OSD, and the process proceeds to a step S205.

Since the contrast of OSD in the dark mode is low, the contents on the screen may not be viewed clearly when the ambient light becomes stronger. Therefore, when the ambient light becomes stronger, the contrast effect of OSD in the dark mode can be improved. During the process of setting the color values of the inverse colors of the first type of colors, the color values of the inverse colors can be decreased on the basis of the stored color values of the inverse colors of the first type of colors. During the process of setting the color values of the inverse colors of the second type of colors, the color values of the inverse colors can be increased on the basis of the stored color values of the inverse colors of the second type of colors.

Step S204: Color values of inverse colors of various colors are set to reduce the contrast effect of OSD.

When the ambient light becomes weaker, in order to be more suitable for viewing the contents on the screen, the contract effect of OSD in the dark mode can be reduced. During the process of setting the color values of the inverse colors of the first type of colors, the color values of the inverse colors can be increased on the basis of the stored color values of the inverse colors of the first type of colors. During the process of setting the color values of the inverse colors of the second type of colors, the color values of the inverse colors can be decreased on the basis of the stored color values of the inverse colors of the second type of colors.

The first type of colors and the second type of colors have been described above and will not be repeated here.

In these embodiments, the first type of colors and the second type of colors involved herein may be the first type of colors and the second type of colors contained in the user interface to be displayed.

In the steps S203 and S204, during the adjustment of the color values of inverse colors of the first type of colors and the second type of colors, it is possible adjust the color values of inverse colors after a set time delay (e.g., 10 s). By this time delay, the user may have time to adapt to the change in light, so that the operation of displaying in the dark mode in the step S205 is more suitable for the user and the user's experience in the dark mode is improved.

By taking a LAB mode as an example, the specific explanation of the step S203 will be exemplarily described below.

The color mode is transformed from an RGB (Red, Green, Blue) mode to a LAB mode, and the LAB mode after transformation consists of one luminance and two color (a, b) axes. The component L represents the brightness of pixels and has a value range of [1, 100], where 0 to 100 represents pure black to pure white. The component A represents a range from red to green, and has a value range of [127, −128]. The component B represents a range from yellow to blue, and has a value range of [127, −128]. When the color mode is transformed from the RGB mode to the LAB mode, it is possible to transform an RGB color space to an XYZ color space and then transform the XYZ color space to a LAB color space.

If the value of L of a color in the LAB mode is 20, it is indicated that the color is very dark and belongs to the second type of colors. A color value of an inverse color of this color is 90, that is, the inverse color is a very bright color. If the value of L of another color in the LAB mode is 80, it is indicated that the color is very bright and belongs to the first type of colors. A color value of an inverse color of this color is 30, that is, the inverse color is a very dark color. When the light becomes stronger, after the color values of the inverse colors of the second type of colors are increased, the brightness of the inverse colors are higher; and, after the color values of the inverse colors of the first type of colors are decreased, the brightness of the inverse color are lower. Overall speaking, the difference in brightness between the brightest region and the darkest region in the user interface displayed in the dark mode becomes greater, and the achieved visual effect is that the contrast of the user interface becomes higher. In other words, when the light becomes stronger and when the user views the contents displayed on the screen of the electronic device, more comfortable visual feel is achieved and the user's experience in the dark mode is improved.

Step S205: Display is performed in the dark mode according to the set color values of inverse colors of various colors.

In these embodiments, during displaying in the dark mode, it is also possible to adjust screen brightness according to the current ambient light information. The screen brightness is positively related to the ambient light information.

Step S206: It is determined whether the current ambient light information is smaller than a set threshold; the process proceeds to a step S207 if the current ambient light information is smaller than the set threshold; and, the process returns to the step S201 if the current ambient light information is not smaller than the set threshold.

In these embodiments, when it is determined that the current ambient light information is smaller than the set threshold, it can be considered that the current environment is a weak light environment. For example, the current environment is in the night, in a dark tunnel or in other scenarios with dark light. In accordance with the general definition of the weak light scenario, the set threshold may be 30 lux.

Step S207: An obscuration function is activated for display, and the process returns to the step S201.

The operations in the steps S206 and S207 of the method may be executed before the step S205. That is, after the color values of inverse colors of various colors are adjusted, the determination operation in the step S206 is executed firstly, the operation in the step S207 is then executed when it is determined that the current ambient light information is smaller than the set threshold, and the operation in the step S205 is executed after that. When it is determined that the current ambient light information is not smaller than the set threshold, the operation in the step S205 can be directly executed.

Figure 3:
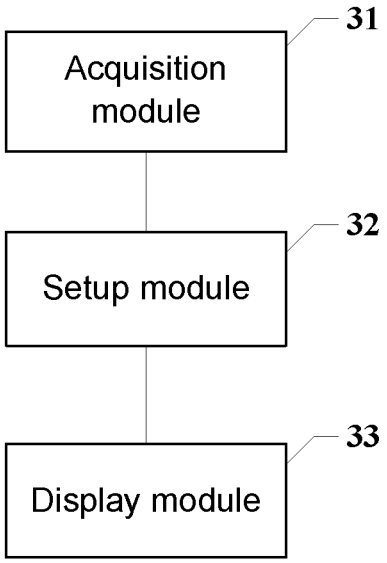
FIG. 3 is a block diagram of an apparatus for controlling OSD according to some embodiments.

FIG. 3 is a block diagram of an apparatus for controlling On-Screen Display (OSD) according to some embodiments. The apparatus includes an acquisition module 31, a setup mode 32 and a display module 33.

The acquisition module 31 is configured to acquire ambient light information.

The setup module 32 is configured to set, according to the ambient light information, OSD parameters suitable for an OSD effect in current light environment.

The display module 33 is configured to perform OSD according to the OSD parameters.

Various embodiments of the present disclosure further provide an apparatus for controlling On-Screen Display (OSD). In this apparatus, the setup module includes:

a first sub-module configured to set color values of inverse colors of a first type of colors according to the ambient light information when it is determined that the OSD mode is a dark mode, the first type of colors comprising colors having a brightness value in a color mode that is greater than or equal to a first set brightness value, the color values of the inverse colors of the first type of colors being negatively related to the ambient light information.

Various embodiments of the present disclosure further provide an apparatus for controlling On-Screen Display (OSD). In this apparatus, the setup module includes:

a second sub-module configured to set color values of inverse colors of a second type of colors according to the ambient light information when it is determined that the OSD mode is a dark mode, the second type of colors comprising colors having a brightness value in a color mode that is smaller than or equal to a second set brightness value, the color values of the inverse colors of the second type of colors being positively related to the ambient light information.

Various embodiments of the present disclosure further provide an apparatus for controlling On-Screen Display (OSD). In this apparatus, the setup module sets, according to the ambient light information, OSD parameters suitable for the OSD effect in current light environment, including:

setting OSD parameters suitable for the OSD effect in the current light environment in a preset way;

wherein the preset way at least comprises any one of the following ways: upon acquiring the ambient light information, setting OSD parameters after a first set time delay.

Various embodiments of the present disclosure further provide an apparatus for controlling On-Screen Display (OSD). This apparatus further includes:

a brightness adjustment module configured to adjust screen brightness according to the ambient light information, the adjusted screen brightness being positively related to the ambient light information when the OSD mode is a dark mode.

Various embodiments of the present disclosure further provide an apparatus for controlling On-Screen Display (OSD). This apparatus further includes:

an obscuration module configured to add an obscuration layer for OSD when the OSD mode is a dark mode and if the acquired ambient light information is smaller than a set threshold.

For the apparatuses in the foregoing embodiments, the specific operations executed by each unit have been described in detail in the embodiments of the methods, and will not be repeated here.

Figure 4:
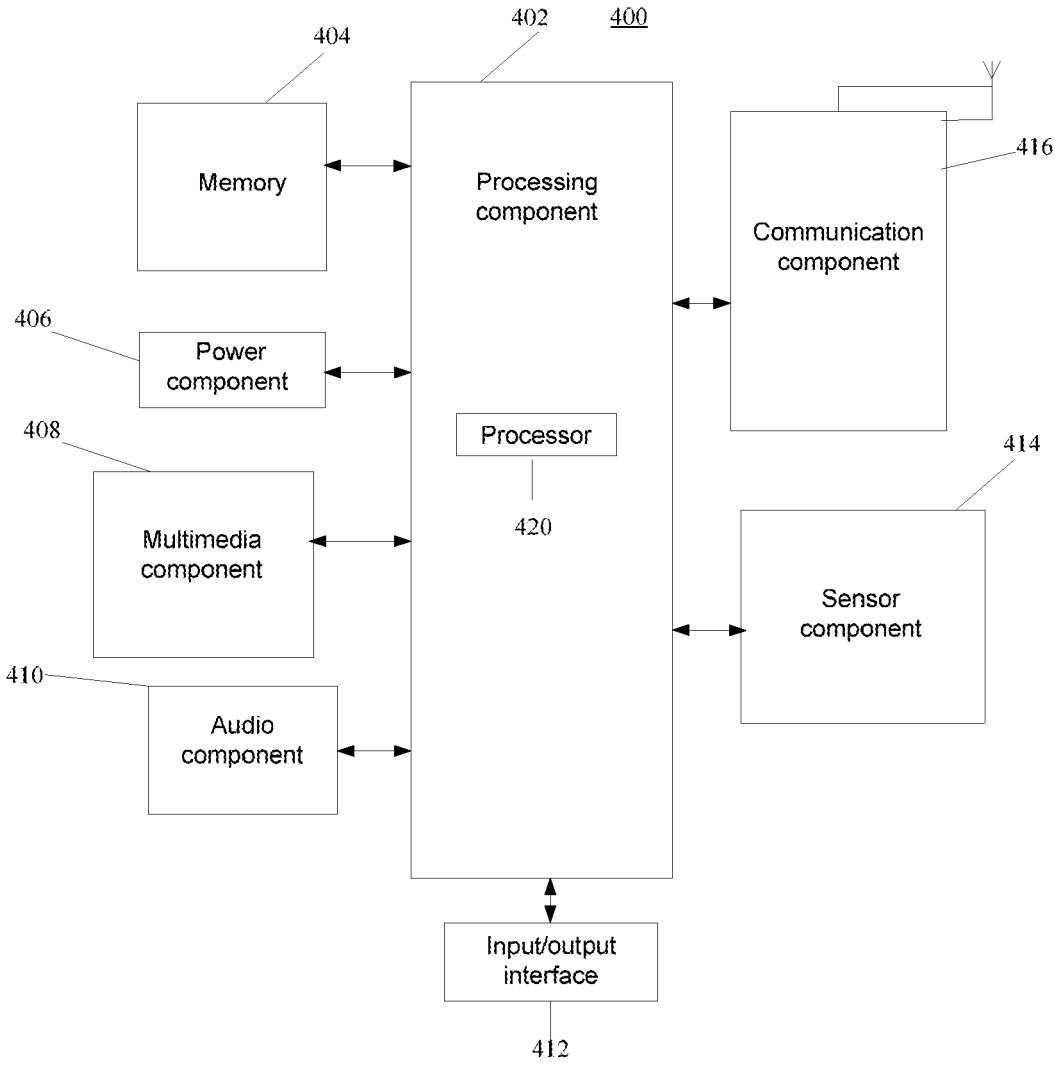
FIG. 4 is a block diagram of an apparatus for controlling OSD according to some embodiments.

FIG. 4 is a block diagram of an apparatus 400 for controlling OSD according to some embodiments. For example, the apparatus 400 may be a mobile phone, a computer, a digital broadcasting terminal, a messaging device, a game console, a tablet device, a medical device, a fitness device, a personal digital assistant or the like.

With reference to FIG. 4, the apparatus 400 may include one or more of the following components: a processing component 402, a memory 404, a power component 406, a multimedia component 408, an audio component 410, an input/output (I/O) interface 412, a sensor component 414 and a communication component 416.

The processing component 402 generally controls the overall operation of the apparatus 400, such as operations associated with display, telephone call, data communication, camera operations and recording operations. The processing component 402 may include one or more processors 420 to execute instructions to complete all or some of the steps in the methods described above. Additionally, the processing component 402 may include one or more modules to facilitate interaction between the processing component 402 and other components. For example, the processing component 402 may include a multimedia module to facilitate interaction between the multimedia component 408 and the processing component 402.

The memory 404 is configured to store various types of data to support the operation of the apparatus 400. Examples of the data include instructions for any application or method operating on the apparatus 400, contact data, phonebook data, messages, pictures, video or the like. The memory 404 may be implemented by any type of volatile or non-volatile storage devices or a combination thereof, for example, static random access memories (SRAMs), electrically erasable programmable read-only memories (EEPROMs), erasable programmable read-only memories (EPROMs), programmable read-only memories (PROMs), read-only memories (ROMs), magnetic memories, flash memories, magnetic disks or optical disks.

The power component 406 supplies power to various components of the apparatus 400. The power component 406 may include a power management system, one or more power supplies, and other components associated with the generation, management and distribution of power for the apparatus 400.

The multimedia component 408 includes a screen to provide an output interface between the apparatus 400 and a user. In some embodiments, the screen may include a Liquid Crystal Display (LCD) and a Touch Panel (TP). In some embodiments, organic light-emitting diode (OLED) or other types of displays can be employed.

If the screen includes a TP, the screen may be implemented as a touch screen to receive input signals from the user. The touch panel includes one or more touch sensors to sense touch, slide and gestures on the touch panel. The touch sensor may sense the boundary of a touch or slide action, and also detect the duration and pressure related to the touch or slide operation. In some embodiments, the multimedia component 408 includes a front camera and/or a rear camera. When the apparatus 400 is in an operation mode, for example, a shooting mode or a video mode, the front camera and/or the rear camera may receive external multimedia data. Each of the front camera and the rear camera may be a fixed optical lens system or have a focal length and an optical zooming capability.

The audio component 410 is configured to output and/or input audio signals. For example, the audio component 410 includes a microphone (MIC). When the apparatus 400 is in an operation mode, for example, a calling mode, a recording mode or a voice recognition mode, the microphone is configured to receive external audio signals. The received audio signals may be further stored in the memory 404 or transmitted via the communication component 416. In some embodiments, the audio component 410 further includes a loudspeaker configured to output the audio signals.

The I/O interface 412 provides an interface between the processing component 402 and a peripheral interface module. The peripheral interface module may be a keyboard, a click wheel, buttons or the like. These buttons may include, but not limited to, a Home button, a Volume button, a Start button and a Lock button.

The sensor component 414 includes one or more sensors configured to provide state evaluation of various aspects of the apparatus 400. For example, the sensor component 414 may detect the on/off state of the apparatus 400 and the relative position of a component. For example, if the component is a display and a keypad of the apparatus 400, the sensor component 414 may also detect the position change of the apparatus 400 or one component of the apparatus 400, the presence or absence of the user's contact with the apparatus 400, the orientation or acceleration/deceleration of the apparatus 400 and the temperature change of the apparatus 400. The sensor component 414 may include a proximity sensor configured to detect the presence of nearby objects without any physical contact. The sensor component 414 may further include an optical sensor (e.g., a CMOS or CCD image sensor) for use in imaging applications. In some embodiments, the sensor component 414 may further include an acceleration sensor, a gyroscope sensor, a magnetic sensor, a pressure sensor or a temperature sensor.

The communication component 416 is configured to facilitate the wired or wireless communication between the apparatus 400 and other devices. The apparatus 400 may access to a wireless network based on communication standards, for example, Wi-Fi, 2G, 3G, 4G, 5G, or a combination thereof. In some embodiments, the communication component 416 receives a broadcast signal or broadcast related information from an external broadcast management system via a broadcast channel. In some embodiments, the communication component 416 further includes a Near-Field Communication (NFC) module to facilitate short-range communication. For example, the NFC module may be implemented based on radio frequency identification (RFID) technologies, infrared data association (IrDA) technologies, ultra-wide band (UWB) technologies, Bluetooth (BT) technologies and other technologies.

In some embodiments, the apparatus 400 may be implemented by one or more application specific integrated circuits (ASICs), digital signal processors (DSPs), digital signal processing devices (DSPDs), programmable logic devices (PLDs), field programmable gate arrays (FPGAs), controllers, microcontrollers, microprocessors or other electronic elements to execute the methods described above.

In some embodiments, a non-temporary computer-readable storage medium including instructions is further provided, for example, the memory 404 including instructions. The instructions may be executed by the processor 420 of the apparatus 400 to complete the methods described above. For example, the non-temporary computer-readable storage medium may be ROMs, random access memories (RAMs), CD-ROMs, magnetic tapes, floppy disks, optical data storage devices or the like.

A non-temporary computer-readable storage medium is provided, instructions in the storage medium, when executed by a processor of a mobile terminal, enabling the mobile terminal to execute a method for controlling On-Screen Display (OSD), the method including steps of:

acquiring ambient light information;

setting, according to the ambient light information, OSD parameters suitable for an OSD effect in current light environment; and performing OSD according to the OSD parameters.

Various embodiments of the present disclosure can have one or more of the following advantages.

OSD parameters can be adjusted in real time according to the ambient light, so that the OSD effect is more suitable for a user's visual feel when viewing a screen in the current light environment, and the user experience is improved.

The various device components, modules, units, blocks, or portions may have modular configurations, or are composed of discrete components, but nonetheless can be referred to as "modules" in general. In other words, the "components," "modules," "blocks," "portions," or "units" referred to herein may or may not be in modular forms, and these phrases may be interchangeably used.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In some embodiments, the control and/or interface software or app can be provided in a form of a non-transitory computer-readable storage medium having instructions stored thereon is further provided. For example, the non-transitory computer-readable storage medium can be a ROM, a CD-ROM, a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a stand-alone program or as a portion, component, subroutine, object, or other portion suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

The invention claimed is:

1. A method for controlling On-Screen Display (OSD), comprising:

acquiring ambient light information;

setting, according to the ambient light information, OSD parameters suitable for an OSD effect in a current light environment; and performing OSD according to the OSD parameters;

wherein the setting, according to the ambient light information, OSD parameters suitable for an OSD effect in current light environment comprises;

when it is determined that the OSD mode is a dark mode, setting color values of inverse colors of a first type of colors according to the ambient light information, the first type of colors comprising colors having a brightness value in a color mode that is greater than or equal to a first set brightness value, the color values of the inverse colors of the first type of colors being negatively related to the ambient light information.

2. The method according to claim 1, wherein the setting, according to the ambient light information, OSD parameters suitable for an OSD effect in current light environment comprises:

when it is determined that the OSD mode is a dark mode, setting color values of inverse colors of a second type of colors according to the ambient light information, the second type of colors comprising colors having a brightness value in a color mode that is smaller than or equal to a second set brightness value, the color values of the inverse colors of the second type of colors being positively related to the ambient light information.

3. The method according to claim 2, wherein the setting, according to the ambient light information, OSD parameters suitable for an OSD effect in current light environment comprises:

setting OSD parameters suitable for the OSD effect in the current light environment in a preset way;

wherein the preset way comprises the following way:

upon acquiring the ambient light information, setting OSD parameters after a first set time delay.

4. The method according to claim 3, further comprising:

adjusting screen brightness according to the ambient light information, the adjusted screen brightness being positively related to the ambient light information when the OSD mode is a dark mode.

5. The method according to claim 3, further comprising:

when the OSD mode is a dark mode and if the acquired ambient light information is smaller than a set threshold, adding an obscuration layer for OSD.

6. The method according to claim 1, wherein the setting, according to the ambient light information, OSD parameters suitable for an OSD effect in current light environment comprises:

when it is determined that the OSD mode is a dark mode, setting color values of inverse colors of a second type of colors according to the ambient light information, the second type of colors comprising colors having a brightness value in a color mode that is smaller than or equal to a second set brightness value, the color values of the inverse colors of the second type of colors being positively related to the ambient light information.

7. A mobile terminal implementing the method of claim 1, comprising a display screen, wherein the mobile terminal is configured to adjust the OSD parameters in real time based on the ambient light, such that the OSD effect is adapted for a user's visual feel when viewing the display screen in the current light environment, to thereby improve user experience.

8. The mobile terminal of claim 7, further comprising a light sensor configured to obtain the ambient light information.

9. The mobile terminal of claim 8, wherein the mobile terminal is configured to:

upon determining that the OSD mode is a dark mode, set color values of inverse colors of a first type of colors according to the ambient light information, the first type of colors including colors having a brightness value in a color mode that is greater than or equal to a first set brightness value, the color values of the inverse colors of the first type of colors being negatively related to the ambient light information;

adjust the color values of the inverse colors of the first type of colors in real time according to change of the ambient light, to thereby optimize display effect in the dark mode;

wherein:

the first type of colors includes various bright colors, and a minimum brightness value for the bright colors is indicated by a first set brightness value;

in a LAB color mode, a maximum value of L is 110, and the first set brightness value is set between 55 and 60.

10. The mobile terminal of claim 9, wherein:

the set color values of the inverse colors of the first type of colors are negatively correlated with the ambient light;

in the dark mode, the brightness of the inverse colors affects contrast of the user interface, and when the ambient light becomes stronger, the set color values of the inverse colors of the first type of colors decrease, dark colors in a displayed picture of the display screen in the dark mode becomes darker, thereby increasing a difference in brightness between a brightest region and a darkest region in the picture displayed on the display screen in the dark mode, and increasing contrast of the displayed picture.

11. The mobile terminal of claim 10, wherein:

when the ambient light becomes weaker, the set color values of the inverse colors of the first type of colors increase, such that the dark colors in the displayed picture become brighter, thereby decreasing the difference in brightness between the brightest region and the darkest region in the displayed picture in the dark mode, and decreasing the contrast of the displayed picture, such that the mobile terminal is configured to facilitate the user's using the dark mode in daytime and night without switching between the dark mode and a light mode.

12. An apparatus for controlling On-Screen Display (OSD), comprising:

a processor; and a memory device configured to store instructions executable for the processor that, when executed by the processor, causes the processor to:

acquire ambient light information;

set, according to the ambient light information, OSD parameters suitable for an OSD effect in current light environment; and perform OSD according to the OSD parameters:

wherein the instructions further cause the processor to:

set color values of inverse colors of a first type of colors according to the ambient light information when it is determined that the OSD mode is a dark mode, the first type of colors comprising colors having a brightness value in a color mode that is greater than or equal to a first set brightness value, the color values of the inverse colors of the first type of colors being negatively related to the ambient light information.

13. The apparatus according to claim 12, wherein the instructions further cause the processor to:

set color values of inverse colors of a second type of colors according to the ambient light information when it is determined that the OSD mode is a dark mode, the second type of colors comprising colors having a brightness value in a color mode that is smaller than or equal to a second set brightness value, the color values of the inverse colors of the second type of colors being positively related to the ambient light information.

14. The apparatus according to claim 13, wherein the instructions further cause the processor to:

set OSD parameters suitable for the OSD effect in the current light environment in a preset way;

wherein the preset way at least comprises the following way:

upon acquiring the ambient light information, setting OSD parameters after a first set time delay.

15. The apparatus according to claim 14, wherein the instructions further cause the processor to:

adjust screen brightness according to the ambient light information, the adjusted screen brightness being positively related to the ambient light information when the OSD mode is a dark mode.

16. The apparatus according to claim 14, wherein the instructions further cause the processor to:

add an obscuration layer for OSD when the OSD mode is a dark mode and if the acquired ambient light information is smaller than a set threshold.

17. The apparatus according to claim 12, wherein the instructions further cause the processor to:

set color values of inverse colors of a second type of colors according to the ambient light information when it is determined that the OSD mode is a dark mode, the second type of colors comprising colors having a brightness value in a color mode that is smaller than or equal to a second set brightness value, the color values of the inverse colors of the second type of colors being positively related to the ambient light information.

18. A non-transitory computer-readable storage medium, instructions in the storage medium, when executed by a processor of a terminal device, enabling the terminal device to execute a method for controlling On-Screen Display (OSD), the method comprising operations of:

acquiring ambient light information;

setting, according to the ambient light information, OSD parameters suitable for an OSD effect in current light environment; and performing OSD according to the OSD parameters;

wherein the setting, according to the ambient light information, OSD parameters suitable for an OSD effect in current light environment comprises;

when it is determined that the OSD mode is a dark mode, setting color values of inverse colors of a first type of colors according to the ambient light information, the first type of colors comprising colors having a brightness value in a color mode that is greater than or equal to a first set brightness value, the color values of the inverse colors of the first type of colors being negatively related to the ambient light information.

* * * * *